US007161289B2

(12) United States Patent
Lee et al.

(10) Patent No.: US 7,161,289 B2
(45) Date of Patent: Jan. 9, 2007

(54) TRIODE STRUCTURE OF FIELD EMISSION DISPLAY AND FABRICATION METHOD THEREOF

(75) Inventors: Chun-Tao Lee, Hsinchu (TW); Cheng-Chung Lee, Hsinchu (TW); Jyh-Rong Sheu, Hsinchu (TW); Yu-Yang Chang, Tainan (TW); Jia-Chong Ho, Taipei (TW); Yu-Wu Wang, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 194 days.

(21) Appl. No.: 10/436,796

(22) Filed: May 13, 2003

(65) Prior Publication Data

US 2004/0104668 A1 Jun. 3, 2004

(30) Foreign Application Priority Data

Dec. 3, 2002 (TW) ..... 91135059 A

(51) Int. Cl.
*H01J 63/04* (2006.01)

(52) U.S. Cl. ..... 313/497; 313/495; 313/496; 313/309; 313/310; 313/311

(58) Field of Classification Search ..... 313/293–304, 313/495–497, 309–311, 336, 351; 315/169.1
See application file for complete search history.

(56) References Cited

U.S. PATENT DOCUMENTS

| | | | | |
|---|---|---|---|---|
| 5,534,744 | A * | 7/1996 | Leroux et al. | 313/309 |
| 6,066,922 | A * | 5/2000 | Iwasaki et al. | 315/169.3 |
| 6,239,547 | B1 * | 5/2001 | Uemura et al. | 313/495 |
| 6,250,984 | B1 * | 6/2001 | Jin et al. | 445/51 |
| 6,765,346 | B1 * | 7/2004 | Lee et al. | 313/497 |
| 2002/0197752 | A1 * | 12/2002 | Choi | 438/20 |
| 2003/0230968 | A1 * | 12/2003 | Lee et al. | 313/495 |

FOREIGN PATENT DOCUMENTS

EP 1096533 A1 * 2/2001

* cited by examiner

*Primary Examiner*—Karabi Guharay
*Assistant Examiner*—Anthony Canning
(74) *Attorney, Agent, or Firm*—Quintero Law Office

(57) ABSTRACT

A triode structure of a field emission display and fabrication method thereof. A plurality of cathode layers arranged in a matrix is formed overlying a dielectric layer. A plurality of emitting layers arranged in a matrix is formed overlying the cathode layers, respectively. A plurality of lengthwise-extending gate lines is formed on the dielectric layer, in which each of the gate layers is disposed between two adjacent columns of the cathode layers.

12 Claims, 19 Drawing Sheets

TRIODE STRUCTURE OF FIELD EMISSION DISPLAY AND FABRICATION METHOD THEREOF

BACKGROUND OF THE INVENTION

1. Field of the Invention

The invention relates to a field emission display (FED) technology, and more particularly to a triode structure with a gate layer and a cathode layer patterned on the same plane during the same process. The triode structure uses the gate layer to pull out electrons from lateral cathode layers, resulting in high luminescent efficiency.

2. Description of the Related Art

Field emission display (FED), a competing technology in the panel display market, is a high-voltage display with a triode structure consisting of anode, cathode, and gate electrodes to achieve high illumination by applying a high voltage and a low current. FED has advantages of light weight and thin profile, like liquid crystal display (LCD), and advantages of high brightness and self luminescence, like cathode ray tube (CRT). In a conventional triode structure of FED, the anode is used to increase energy of electrons, the cathode is used to emit electrons and the gate electrode is used to pull electrons out from the cathode, thus the triode structure can increase luminescent efficiency and reduce controlled voltage. With regard to the fabrication of an electron-emitting source, molybdenum (Mo) metal is employed to form a micro-tip shape, despite the attendant problems of complex process, expensive equipment cost, and low throughput. Recently, carbon nanotubes (CNTs), having highs mechanical strength and great electrical performance, have been coated/grown within an electron-emitting area as an electron-emitting source, resulting in a CNT-FED device.

FIG. 1 is a sectional diagram showing a conventional CNT-FED device. The CNT-FED device 10 has a cathode substrate 12, an anode substrate 14 over and parallel to the cathode substrate 12, and a spacer disposed in the vacuum space between the two substrates 12 and 14 for maintaining a predetermined vertical distance and resisting atmospheric pressure. Generally, the two substrates 12 and 14 are glass substrates. The anode substrate 14 has a plurality of transverse-extending anode layers 16 of ITO, a black matrix layer 18, a plurality of fluorescent layers 20 and planarized Al film 22. The fluorescent layers 20 consist of a red layer 20R, a green layer 20G and a blue layer 20B. The Al film 22 is employed as a conductive layer of the anode substrate 14, a reflective layer of the fluorescent layer 20 and a protective layer for protecting the fluorescent layer 20 from ion bombardment and electric-field attraction. The cathode substrate 12 has a plurality of lengthwise-extending cathode layers 24, a plurality of CNT emitting layers 26 formed on each electron-emitting area of the cathode layer 24, an insulating layer 28 formed on peripheral region of each electron-emitting area for isolating adjacent CNT emitting layers 26, and a gate electrode layer 29 patterned on the insulating layer 28.

In one method of forming the CNT emitting layer 26, the CNT material is formed within the electron emitting area prior to deposition, sintering and etching for the formation of the insulating layer 28 and the gate electrode layer 29. However, those processes consisting of deposition, sintering and etching may deteriorate the CNT, resulting in unstable emission. In another method of forming the CNT emitting layer 26, the insulating layer 28 and the gate electrode layer 29 are formed to provide an opening corresponding to the electron emitting area, and then the opening is filled with the CNT material. However, this easily causes a short circuit between the gate electrode layer 29 and the cathode layer 24, and it is difficult to accurately control the opening depth for filling the CNT material and the uniformity of the CNT material on the electron emitting area.

Accordingly, a reflective-type electrode and an under-gated structure have been developed to simplify the FED process and achieve the same characteristics provided by the above-described triode structure.

FIG. 2A is a reflective-type electrode structure of a conventional CNT-FED device. FIG. 2B is a sectional diagram of a pixel unit of the reflective-type electrode structure. A reflective-type triode structure 30 comprises a bottom glass substrate 32 and an upper glass substrate. The bottom glass substrate 32 comprises a plurality of transverse-extending anode layers 34, a plurality of transverse-extending fluorescent layers 36R, 36G and 36B, a plurality of lengthwise-extending dielectric layers 38, a plurality of lengthwise-extending cathode layers 40 and a plurality of CNT emitting layers 42 arranged in a matrix. The upper glass substrate comprises a transparent conductive layer 44. In a pixel unit, the anode layer 34 provides an anode electrical field to pull electrons out of the cathode layer 40 by a lateral force. Meanwhile, the transparent conductive layer 44 provides a cathode electrical field to push electrons downward. Thus, the anode voltage and the cathode voltage between the two substrates 44 and 32 can gather an electron beam and the electrons precisely bombard the fluorescent layer 36, resulting in luminescence.

The reflective-type electrode structure 30 has a simplified process and stable emitting property because the CNT emitting layer 42 can be formed during the last procedure without suffering damage from the subsequent processes. Also, a surface treatment can be further performed on the CNT emitting layer 42 to improve electron emitting characteristics thereof. However, limited to driving circuits for the reflective-type structure 30, the anode voltage is 2~300V that is insufficient for high luminescence. Moreover, since the control of the anode voltage and the cathode voltage is complex, it is difficult to gather the electron beam.

FIG. 3A is a solid diagram showing an under-gate structure of a conventional CNT-FED device. FIG. 3B is a sectional diagram of an under-gate structure of a conventional CNT-FED device. AN under-gate structure 50 comprises a lower glass substrate 52 and an upper glass substrate 64. The lower glass substrate 52 comprises a plurality of transverse-extending counter electrode layers 54, an insulating layer 55, a plurality of under-gate layers 56 arranged in a matrix, a plurality of lengthwise-extending cathode layers 58 and a plurality of lengthwise-extending CNT emitting layers 60. The upper glass substrate 62 comprises a plurality of transverse-extending anode layers 64 and a plurality of transverse-extending fluorescent layers 66. In the under-gate structure 50, electrons are pulled out from the CNT emitting layer 60 by the under-gate layer 56 and are then sped by a voltage of the anode layer 64 to bombard the fluorescent layer 66.

The under-gate structure 50 has the same advantages as the reflective-type structure 30 despite the attendant disadvantages as follow. First, the voltage of the anode layer 64 must be precisely controlled to ensure that the electron beam bombard an appropriate position. Second, in order to stop luminance, a negative voltage should be provided by the under-gate layer 56 to restrain electrons from emission, thus an extra control voltage level is needed. Third, in order to prevent the cross-talk effect between the under-gate layer 56 and the cathode layer 58, the interval between the two adjacent cathode layers 58 should be larger to increase the space between the under-gate layer 56 and the cathode layer 58.

SUMMARY OF THE INVENTION

Accordingly, an object of the invention is a triode structure of a field emission display having a gate layer and a cathode layer patterned on the same plane at the same process to solve the problems caused by the conventional CNT-FED devices.

Another object of the present invention is to provide a method for fabricating a triode structure of a field emission display to pattern a gate layer and a cathode layer patterned on the same plane at the same process so as to solve problems caused by the conventional CNT-FED devices.

In order to achieve the above objects, the invention provides a triode structure of a field emission display as follows. A plurality of transverse-extending conductive layers is formed overlying the inner surface of a lower substrate. A dielectric layer is formed overlying the conductive layers and the lower substrate, in which the dielectric layer comprises a plurality of openings arranged in a matrix to expose portions of the conductive layers. A plurality of contact layers is formed in the openings to electrically connect the conductive layers, respectively. A plurality of cathode layers arranged in a matrix is formed overlying the dielectric layer, in which each of the cathode layers is connected to each of the contact layers. A plurality of emitting layers arranged in a matrix is formed overlying the cathode layers, respectively. A plurality of lengthwise-extending gate line is formed on the dielectric layer, in which each of the gate layers is disposed between two adjacent columns of the cathode layers.

In order to achieve the above objects, the invention provides a fabricating method of a triode structure of a field emission display. A plurality of transverse-extending conductive layers is formed overlying the inner surface of the lower substrate. Then, a dielectric layer is formed overlying the conductive layers and the lower substrate. Next, a plurality of openings arranged in a matrix is formed in the dielectric layer to expose portions of the conductive layers. Next, a metal layer is formed overlying the dielectric layer, in which the metal layer filling the openings serves as a plurality of contact layers to electrically connect the conductive layers, respectively. Then, the metal layer on the dielectric layer is patterned as a plurality of cathode layers arranged in a matrix and a plurality of lengthwise-extending gate layers, in which each of the cathode layers is connected to each of the contact layers, and each of the gate layers is disposed between two adjacent columns of the cathode layers. Thereafter, a plurality of emitting layers arranged in a matrix is formed on the cathode layers, respectively.

DESCRIPTION OF THE DRAWINGS

For a better understanding of the present invention, reference is made to a detailed description to be read in conjunction with the accompanying drawings, in which.

DETAILED DESCRIPTION OF THE INVENTION

First Embodiment

Figure 1:
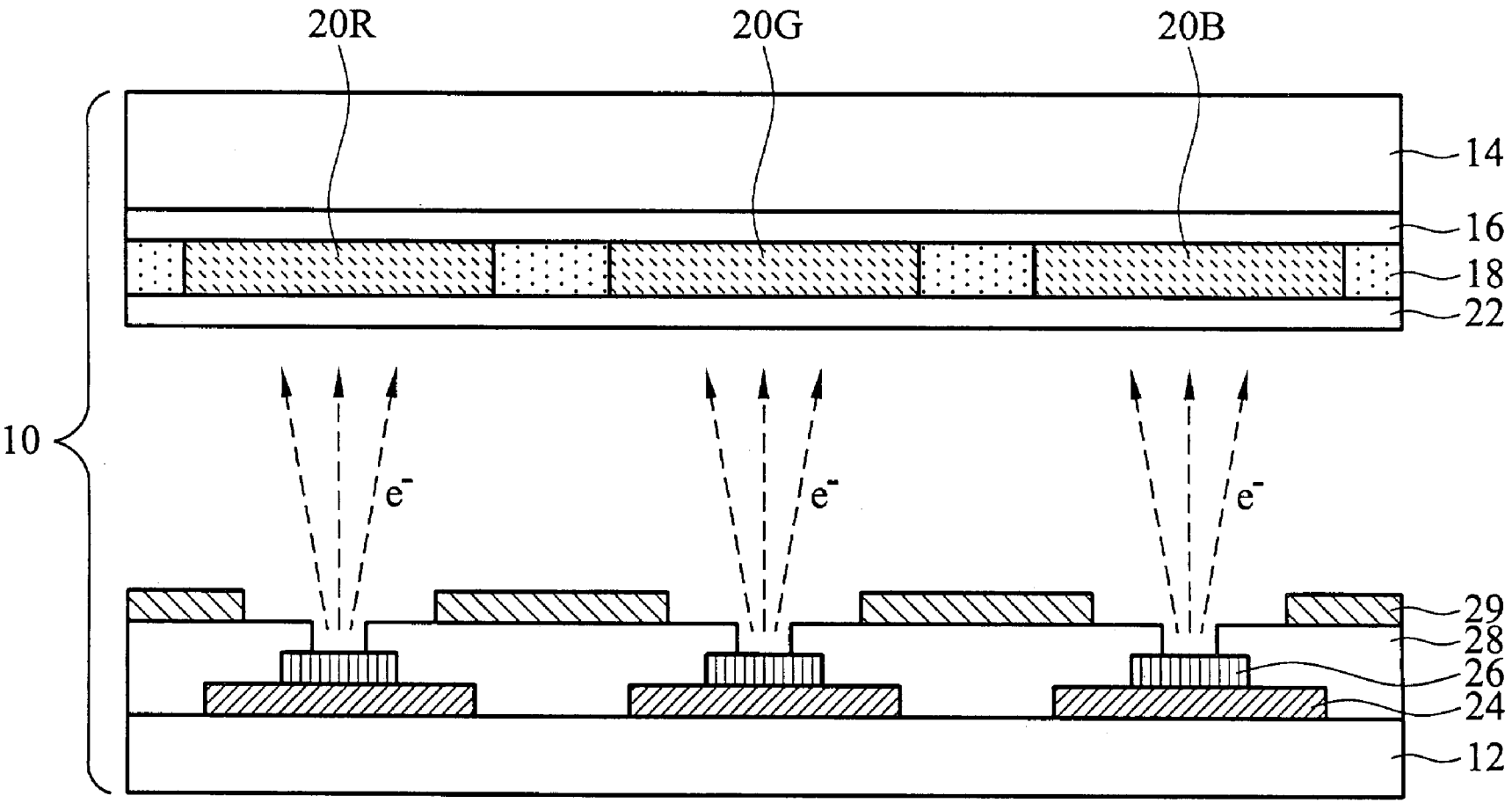
FIG. 1 (PRIOR ART)
FIG. 1 is a sectional diagram showing a conventional CNT-FED device.
Figure 2A:
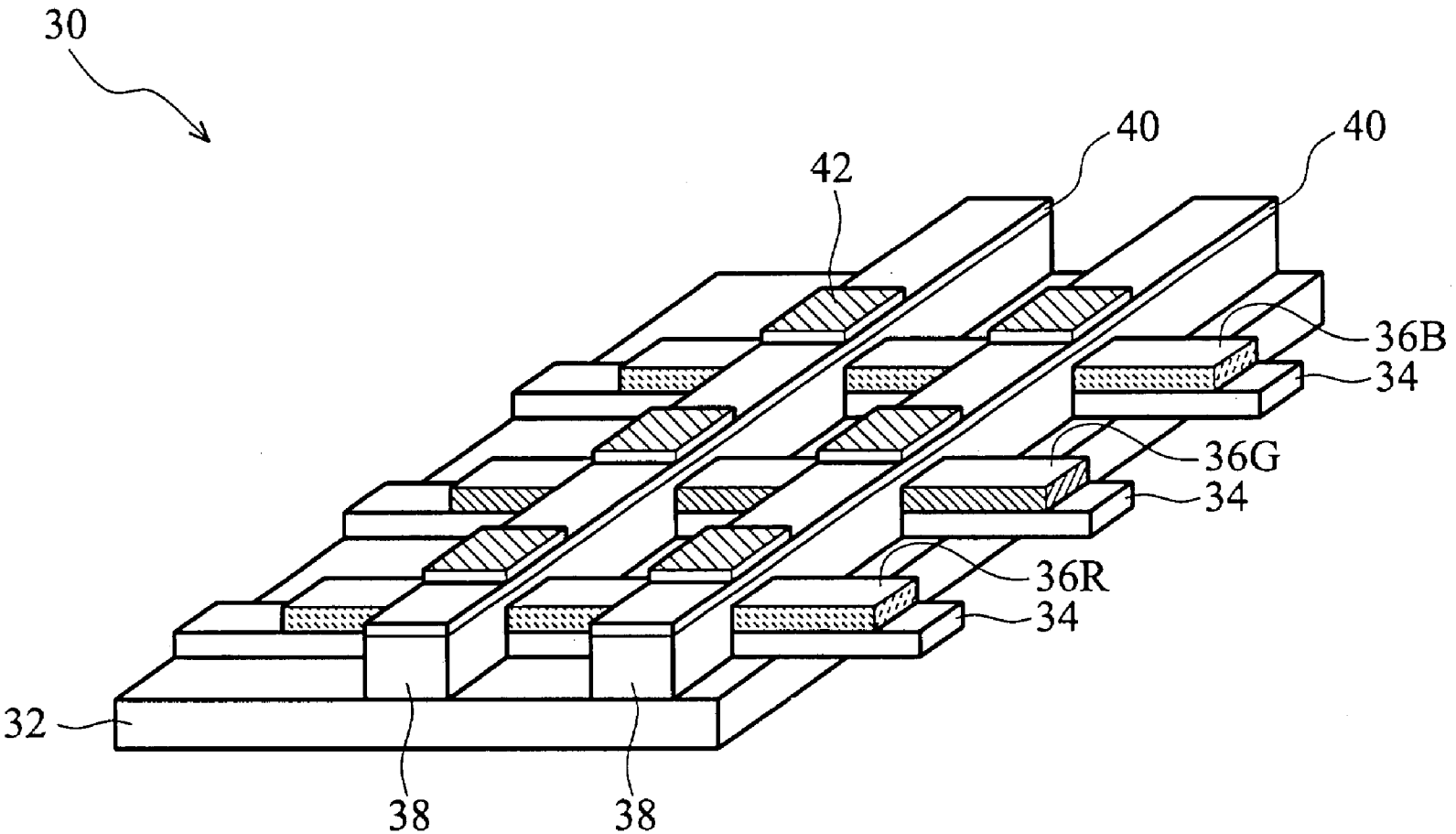
FIG. 2A (PRIOR ART)
FIG. 2A is a reflective-type electrode structure of a conventional CNT-FED device.
Figure 2B:
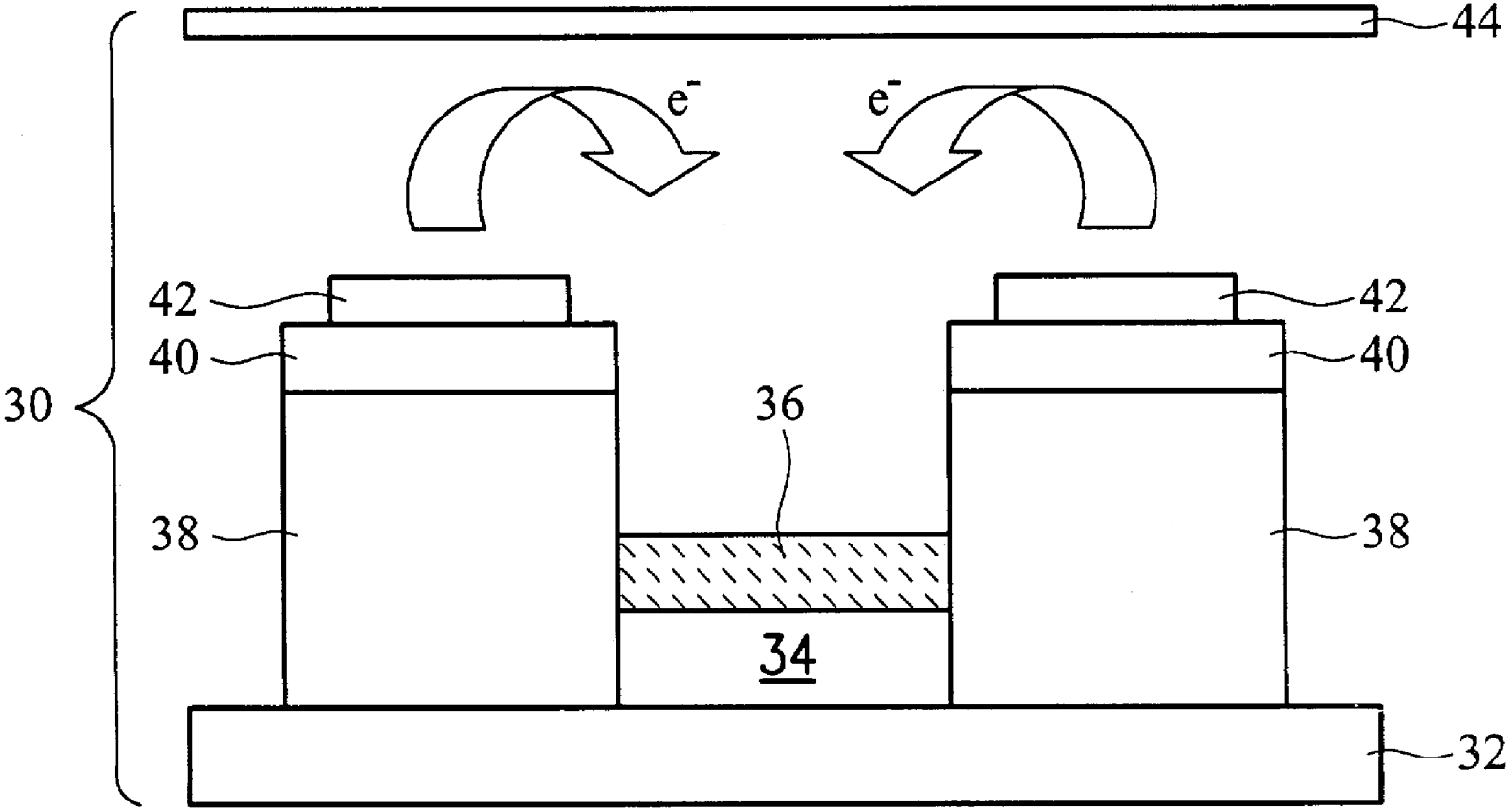
FIG. 2B (PRIOR ART)
FIG. 2B is a sectional diagram of a pixel unit of the reflective-type electrode structure.
Figure 3A:
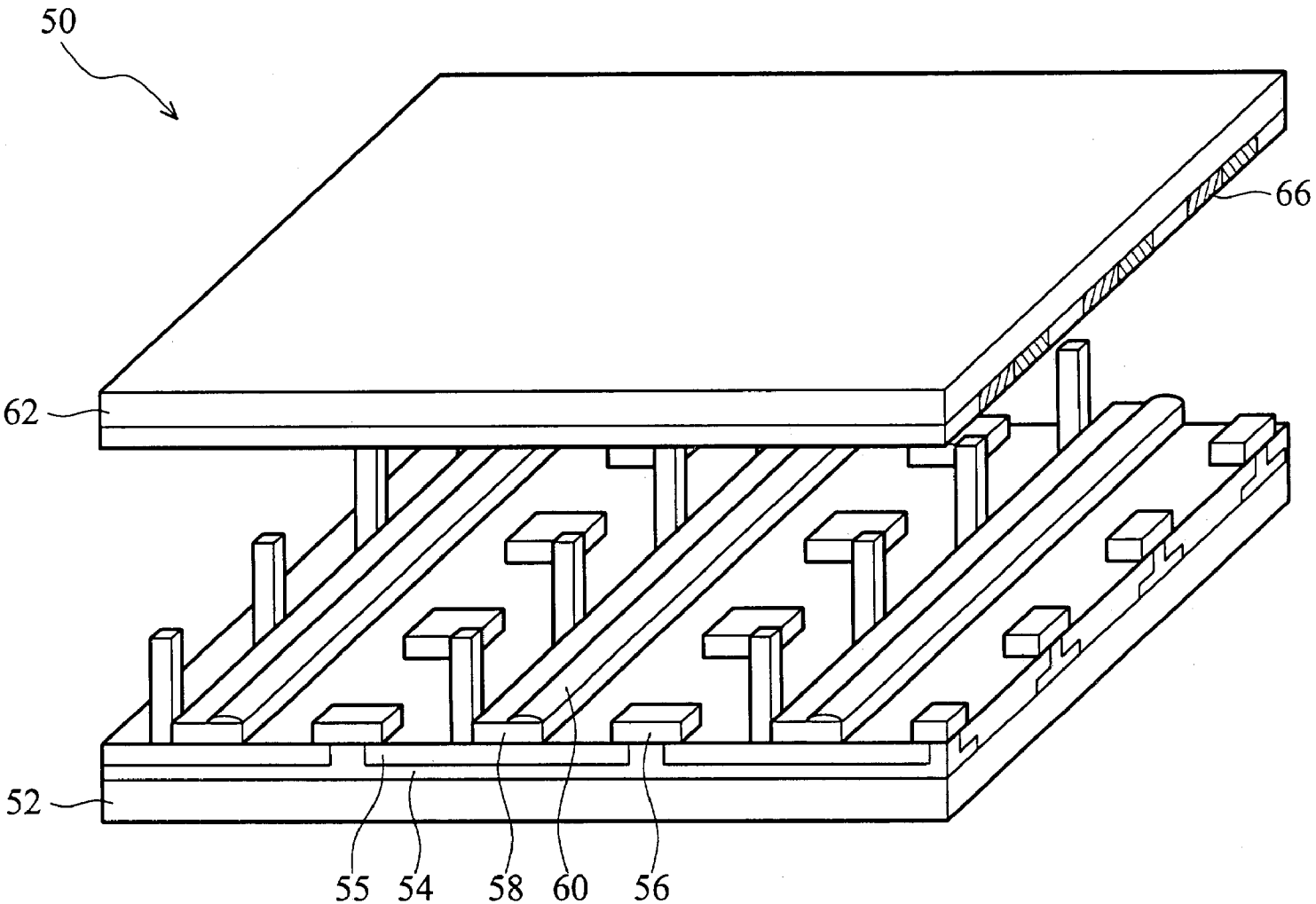
FIG. 3A (PRIOR ART)
FIG. 3A is a solid diagram showing an under-gate structure of a conventional CNT-FED device.
Figure 3B:
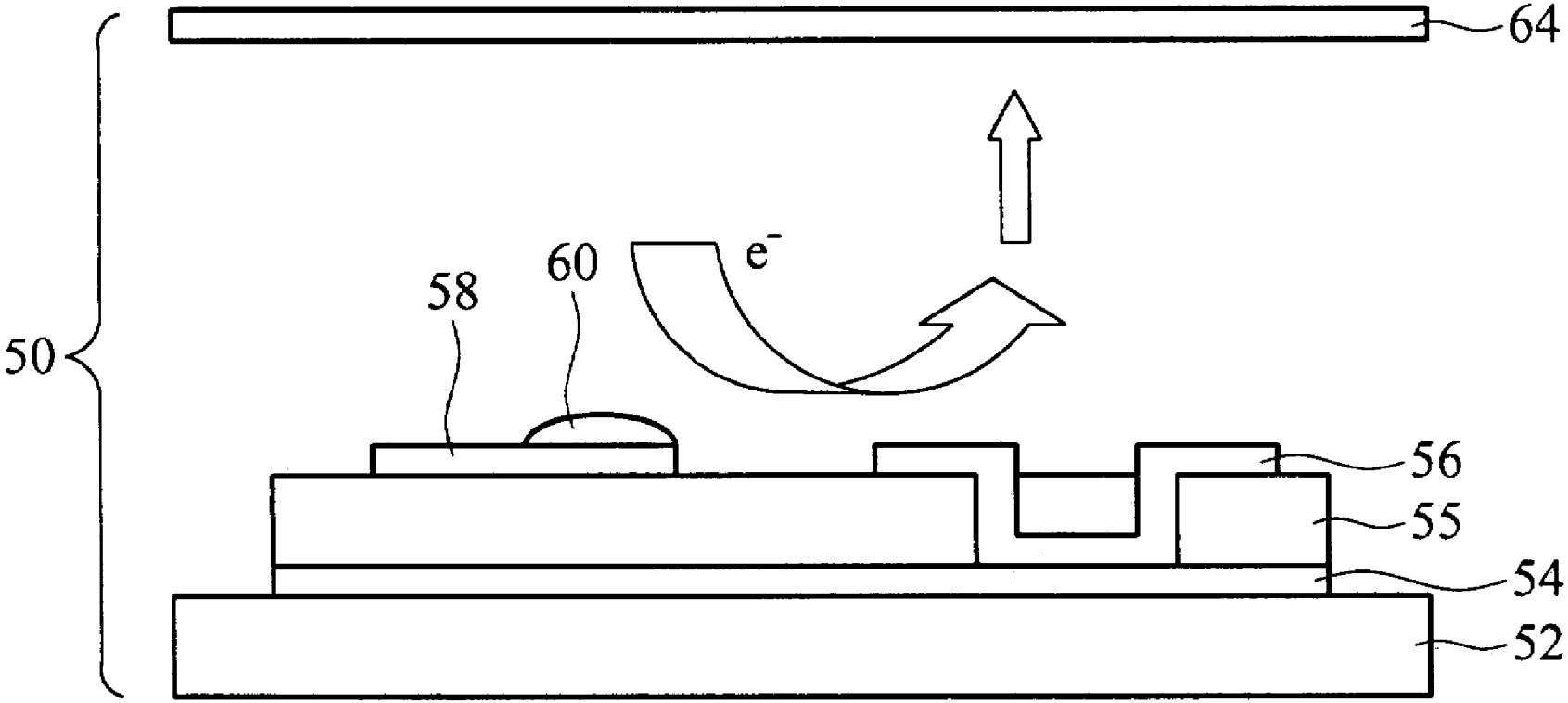
FIG. 3B (PRIOR ART)
FIG. 3B is a sectional diagram of an under-gate structure of a conventional CNT-FED device.
Figure 4A:
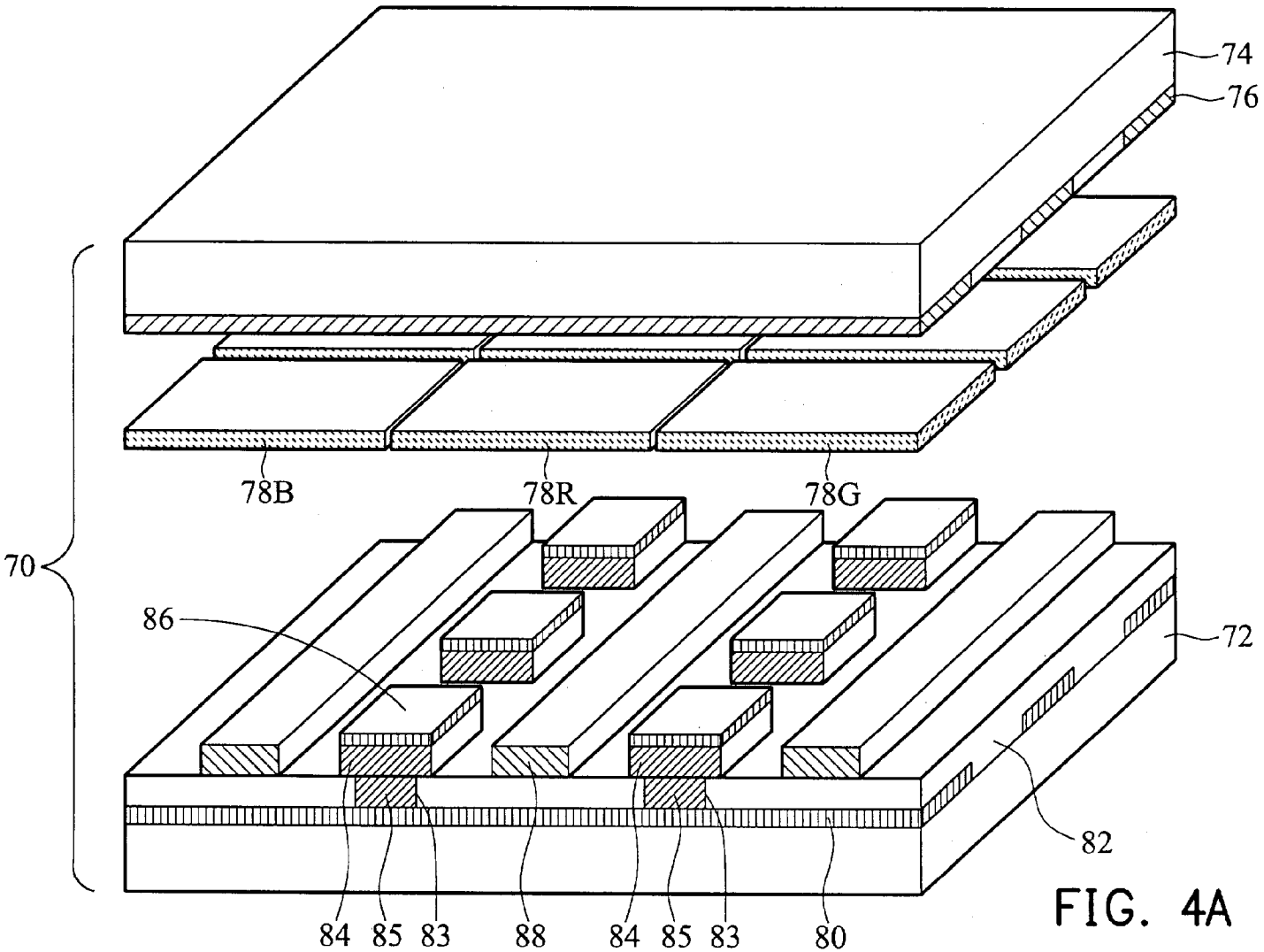
FIG. 4A is a solid diagram showing a triode structure of a FED device according to the first embodiment of the present invention.
Figure 4B:
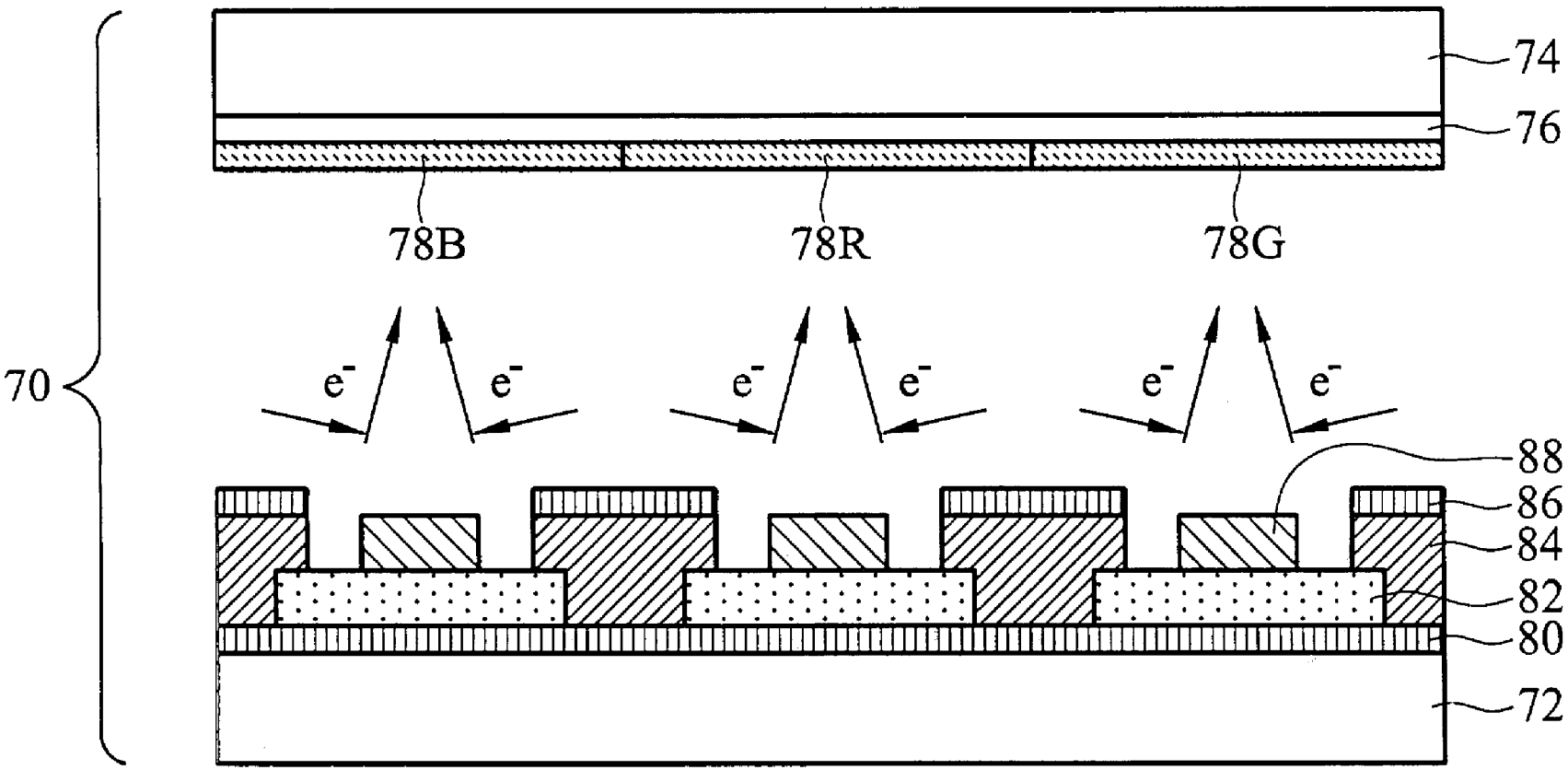
FIG. 4B is a sectional diagram of the triode structure shown in FIG. 4A.

FIG. 4A is a solid diagram showing a triode structure of a FED device according to the first embodiment of the present invention. FIG. 4B is a sectional diagram of the triode structure shown in FIG. 4A.

A FED device 70 is constituted by a lower substrate 72 and an upper substrate 74 arranged in parallel to each other. Preferably, glass panel material is used to form the two substrates 72 and 74. Alternatively, a transparent insulating material is used to form the two substrates 72 and 74. In addition, a spacer is provided in the vacuum between the two substrates 72 and 74 for maintaining a predetermined vertical distance and resisting atmospheric pressure.

The upper substrate 74, serving as an anode substrate, comprises a plurality of transverse-extending anode layers 76 and a plurality of fluorescent layers 78 arranged in a matrix formed on the inner surface thereof. Preferably, the anode layer 76 is ITO, and the fluorescent layer 78 consists of a red fluorescent layer 78R, a green fluorescent layer 78G and a blue fluorescent layer 78B. In addition, depending on demands for FED process and luminescent properties, a black matrix pattern and an aluminum film can be selectively provided on the upper substrate 74.

The lower substrate 72 serves as a cathode substrate. A plurality of transverse-extending conductive layers 80 are patterned on the inner surface of the lower substrate 72. A dielectric layer 82 is deposited on the conductive layers 80 to fill the space between two adjacent conductive layers 80, in which a plurality of openings 83 arranged in a matrix is formed to expose portions of the conductive layers 80. A plurality of contact layers 85 is formed in the openings 83, respectively, to be electrically connected to the conductive layers 80. A plurality of cathode layers 84 arranged in a matrix is formed on the dielectric layer 82 and connected to the contact layers 85, respectively. A plurality of emitting layers 86 arranged in a matrix is formed on the electron-emitting areas of the cathode layers 84, respectively. A plurality of lengthwise-extending gate layers 88 is patterned on the dielectric layer 82, in which each of the gate layers 88 is disposed between two columns of cathode layers 84.

The emitting layer 86 may be made of a CNT film, nano particles (such as carbon sphere, nano cluster or CNF), a diamond film or porous silicon to serve as a nano-scale plane emitting source. The design choices consisting of area, number and interval of the emitting layer 86 are not limited in the present invention.

In the triode structure of the FED device 70, a lateral force provided by the gate layer 88 can pull electrons from the two emitting layers 86 formed on the two cathode layers 84 that are disposed at two sides of the gate layer 88. At the same time, a voltage provided by the anode layer 76 can speed those electrons to bombard the corresponding fluorescent layer 78.

In comparison with the conventional under-gate structure, the triode structure of FED device 70 employs the gate layer 88 to pull out electrons from two lateral cathode layers 84, thus concentrates electron beams on the correctly-bombarded position without cross-talk effect between the gate layer 88 and the cathode layer 84. Accordingly, there is no need to increase the interval between two adjacent cathode layers 84 to increase the space between the gate layer 88 and the cathode layer 84.

With regard to the fabrication method of the triode structure of the FED device 70, FIGS. 5A to 5D are solid diagrams showing a fabrication method of the triode structure according to the first embodiment of the present invention.

Figure 5A:
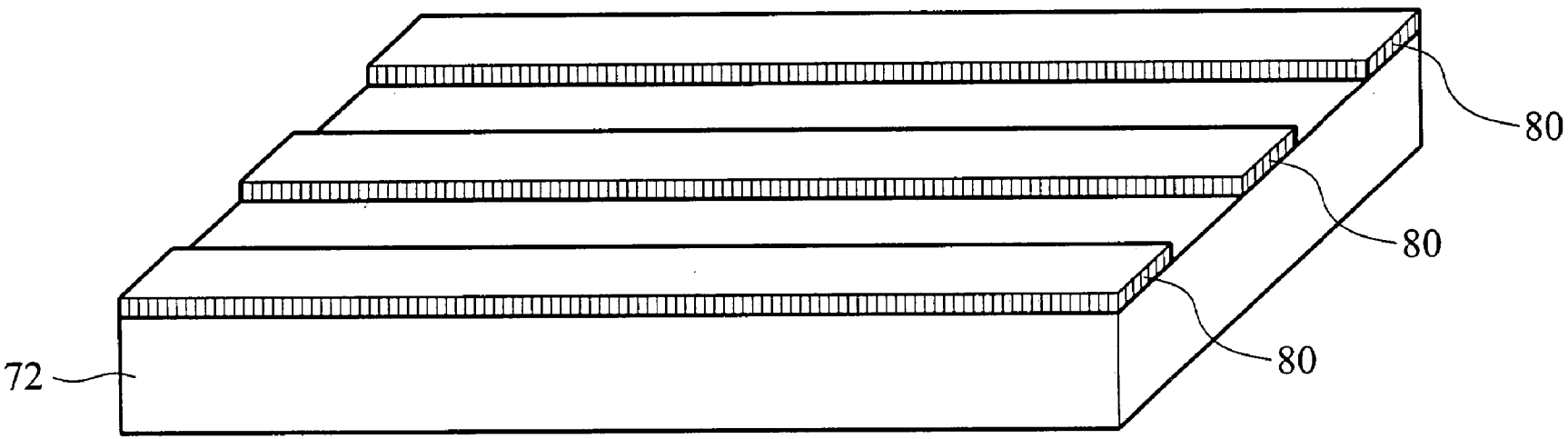
FIGS. 5A to 5D are solid diagrams showing a fabrication method of the triode structure according to the first embodiment of the present invention.
Figure 5B:
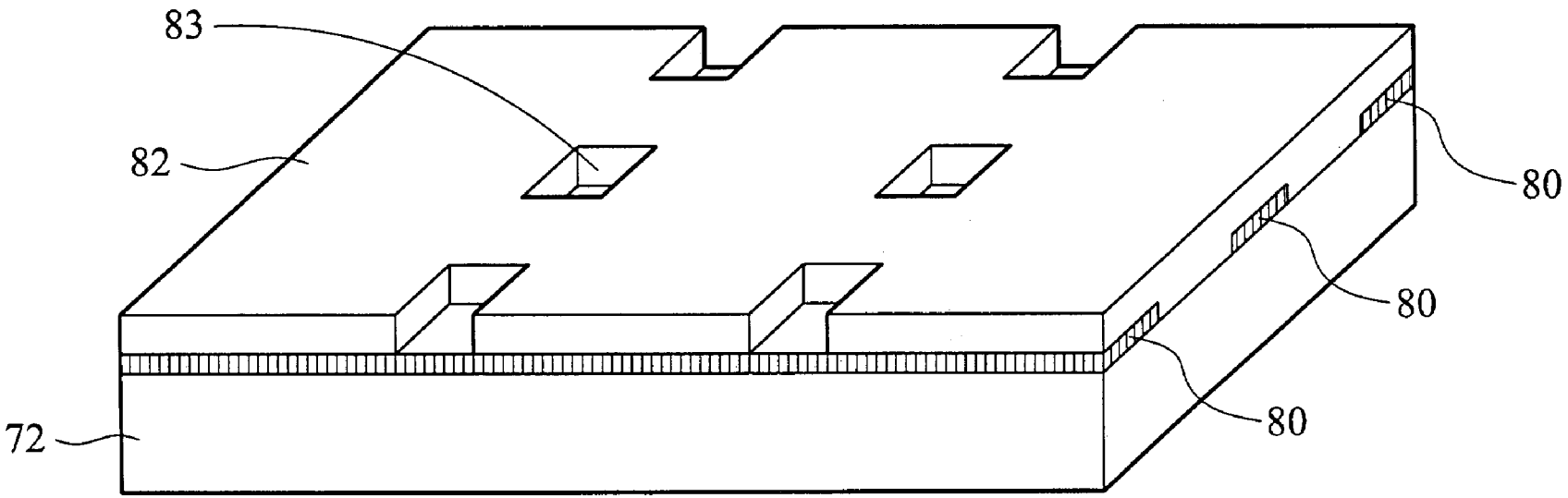
Figure 5C:
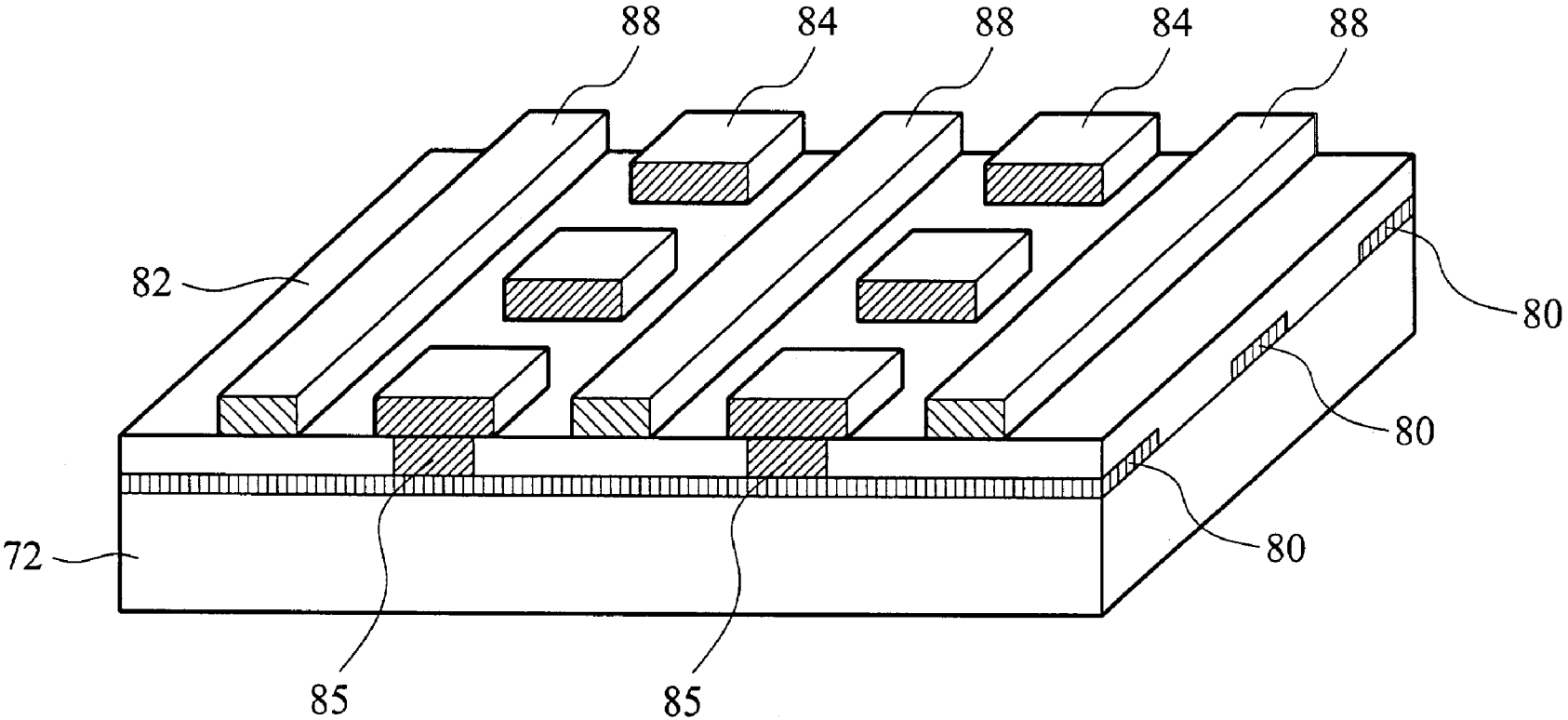
Figure 5D:
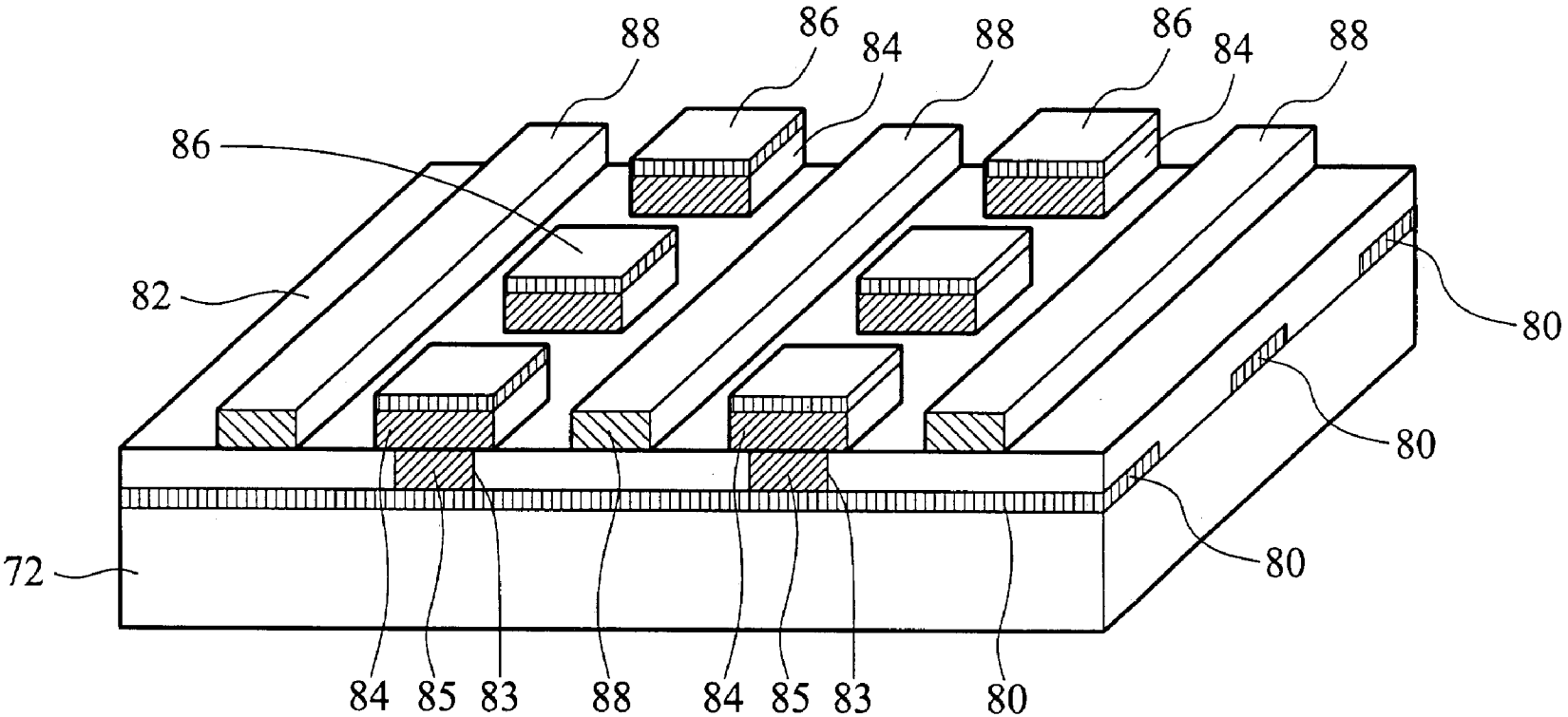

First, in FIG. 5A, using net printing or metal deposition with lithography, the conductive layer 80 of a transverse-stripe profile is patterned on the lower substrate 72. Then, in FIG. 5B, using net printing or deposition with lithography, the dielectric layer 82 with the openings 83 arranged in a matrix is patterned on the entire surface of the lower substrate 72, in which each of the openings 83 exposes an area of the conductive layer 80 for electrically connecting to the cathode layer 84. Next, in FIG. 5C, using net printing or metal deposition with lithography, the openings 83 are filled with a metal material to serve as the contact layers 85, respectively. Also, the metal material deposited on the dielectric layer 82 is patterned as the cathode layers 84 and the gate layers 88. The cathode layers 84 arranged in a matrix are connected to the contact layers 85, respectively. The gate layers 88 extending in the lengthwise direction are disposed between two columns of cathode layers 84. Finally, in FIG. 5D, using net printing or metal deposition with lithography, the emitting layers 86 are patterned on the cathode layers 84, respectively.

According to the above-described fabrication method, the gate layer 88 and the cathode layer 84 are completed at the same step on the same plane, thus the FED device 70 serves as a plane emitting source. Also, the emitting layer 86 can be formed in the last procedure without suffering damage from the subsequent processes and a surface treatment can be further performed on the emitting layer 86 to improve electron emitting characteristics thereof, thus the FED device 70 has stable emitting properties.

Second Embodiment

Figure 6A:
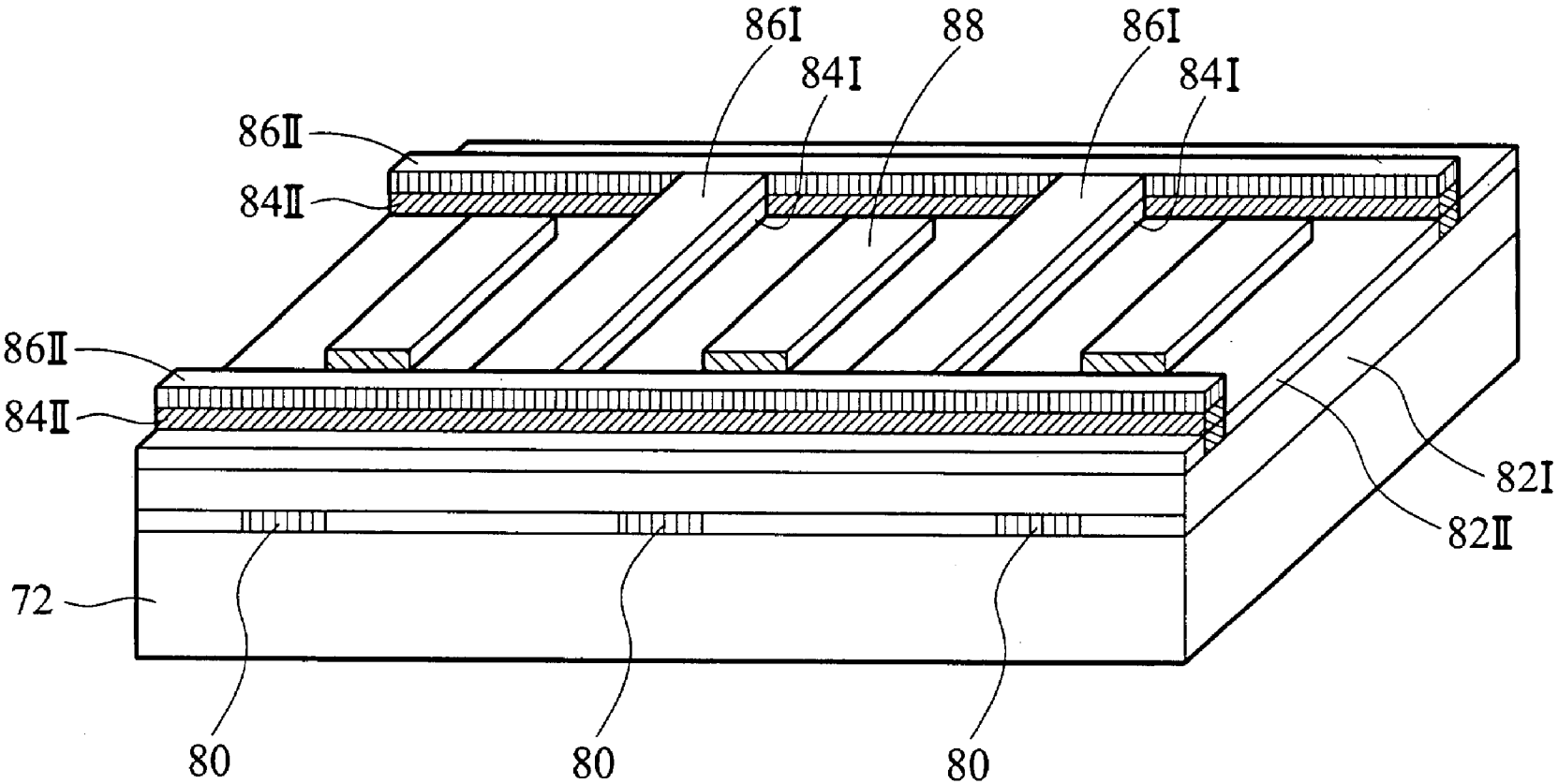
FIG. 6A is a solid diagram showing a triode structure of a FED device according to the second embodiment of the present invention.
Figure 6B:
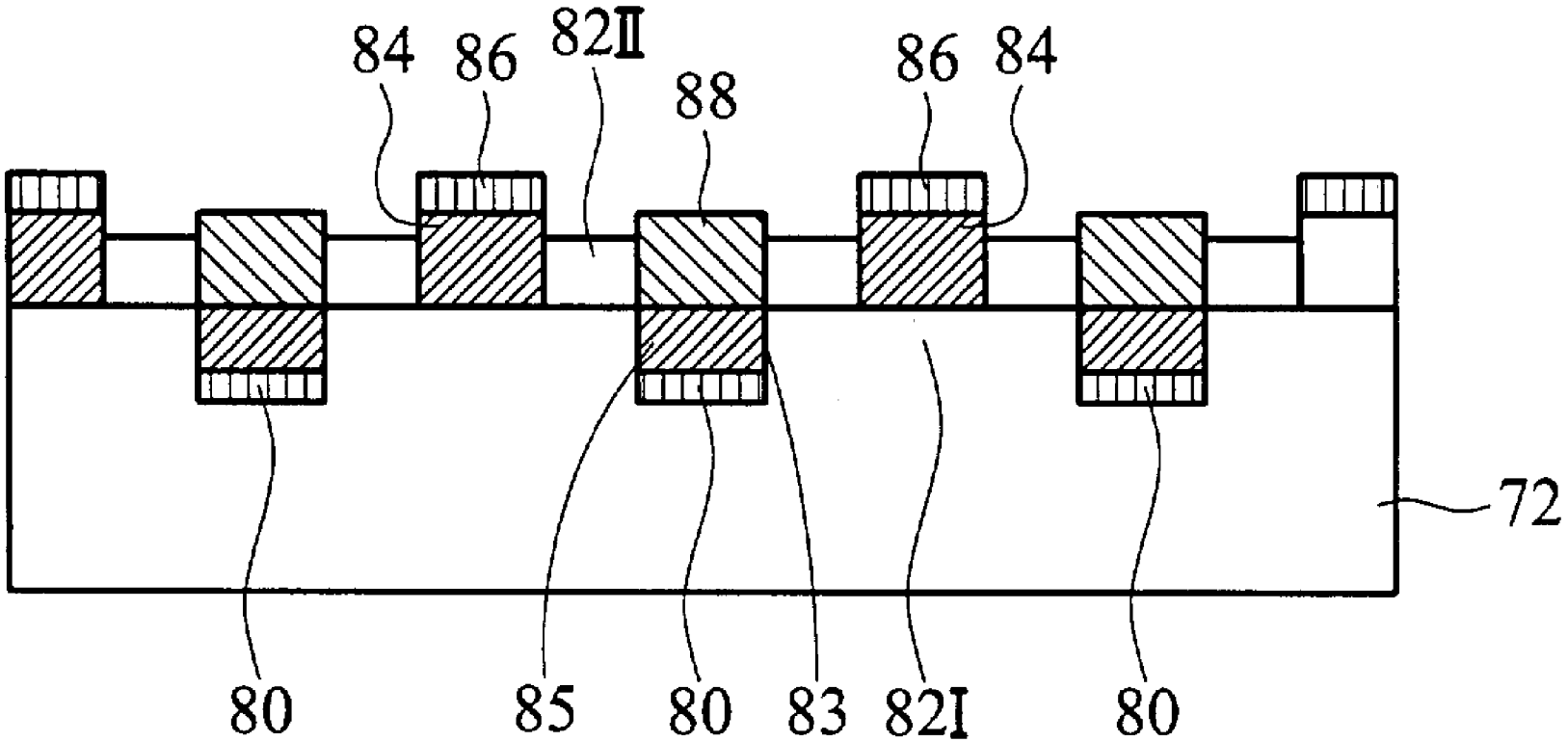
FIG. 6B is a sectional diagram of the triode structure shown in FIG. 6A.

FIG. 6A is a solid diagram showing a triode structure of a FED device according to the second embodiment of the present invention. FIG. 6B is a sectional diagram of the triode structure shown in FIG. 6A.

According to the electrode structure on the lower substrate 72 described in the first embodiment, the second embodiment modifies the cathode layer 84 and the emitting layer 86 to make the periphery of the gate layer 88 within one pixel area overall surrounded by the emitting layer 86.

The lower substrate 72 serves as a cathode substrate. A plurality of lengthwise-extending conductive layers 80 is patterned on the inner surface of the lower substrate 72. A first dielectric layer 82I is deposited on the conductive layers 80 and the lower substrate 72, and has a plurality of openings 83 to expose portions of the conductive layers 80 for electrically connecting cathode layers. A plurality of contact layers 85 is formed in the openings 83, respectively, to be electrically connected to the conductive layers 80. A cathode pattern 84 with rectangular spacings arranged in a matrix is formed on the first dielectric layer 82I, in which a plurality of first cathode layers 84I extending in the lengthwise direction and a plurality of second cathode layers 84II extending in the transverse direction intersect to form the cathode pattern 84. An emitting pattern 86 with rectangular spacings arranged in a matrix is formed on the cathode pattern 84, in which a plurality of first emitting layers 86I extending in the lengthwise direction and a plurality of second emitting layers 86II extending in the transverse direction intersect to form the emitting pattern 86. A plurality of gate layers 88 is patterned on the first dielectric layer 82I, in which each of the gate layers 88 is disposed within the rectangular spacing defined by the first cathode layer 84I and the second cathode layer 84II. A second dielectric layer 82II is formed on the first dielectric layer 82I to fill the space between the cathode pattern 84 and the gate layer 88, in which the top of the cathode pattern 84 and the top of the gate layer 88 protrude from the second dielectric layer 82II. In FIG. 6B, the contact layer 85 is formed in the opening 83 beneath the gate layer 88 to electrically connect the gate layer 88 and the conductive layer 80.

The emitting pattern 86 may be made of a CNT film, nano particles (such as carbon sphere, nano cluster, or CNF), a diamond film, or porous silicon to serve as a nano-scale plane emitting source. The design choices consisting of area, number and interval of the emitting pattern 86 are not limited in the present invention.

In the second embodiment of the present invention, the triode structure of FED device employs the emitting pattern 86 to surround the overall periphery of the gate layer 88, thus the gate layer 88 can pull out electrons from four lateral cathode layers 84I and 84II to further concentrate electron beams, control voltage, improve resolution and ensure luminescent properties. Also, the second dielectric layer 82II filling the space between the cathode pattern 84 and the gate layer 88 can effectively prevent cross-talk effect or a short circuit between the gate layer 88 and the cathode layers 84I and 84II.

With regard to the fabrication method of the above-described triode structure, FIGS. 7A to 7E are solid diagrams showing a fabrication method of the triode structure according to the second embodiment of the present invention.

Figure 7A:
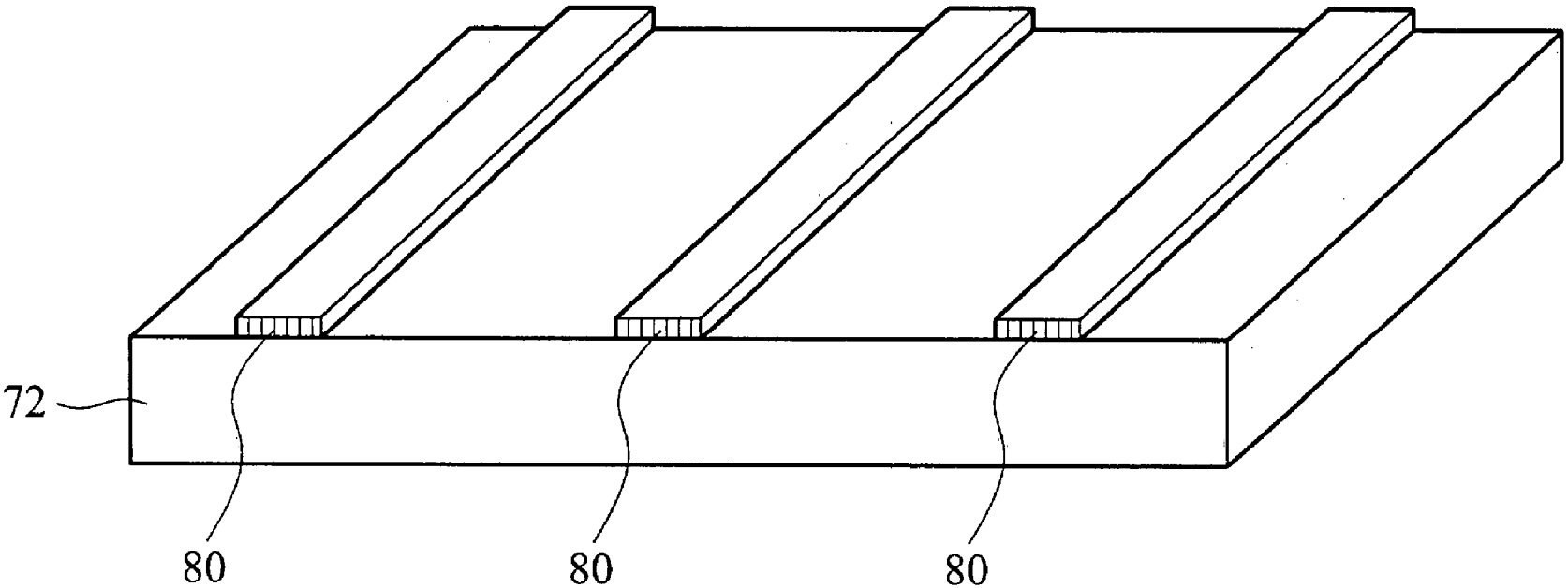
FIGS. 7A to 7E are solid diagrams showing a fabrication method of the triode structure according to the second embodiment of the present invention.
Figure 7B:
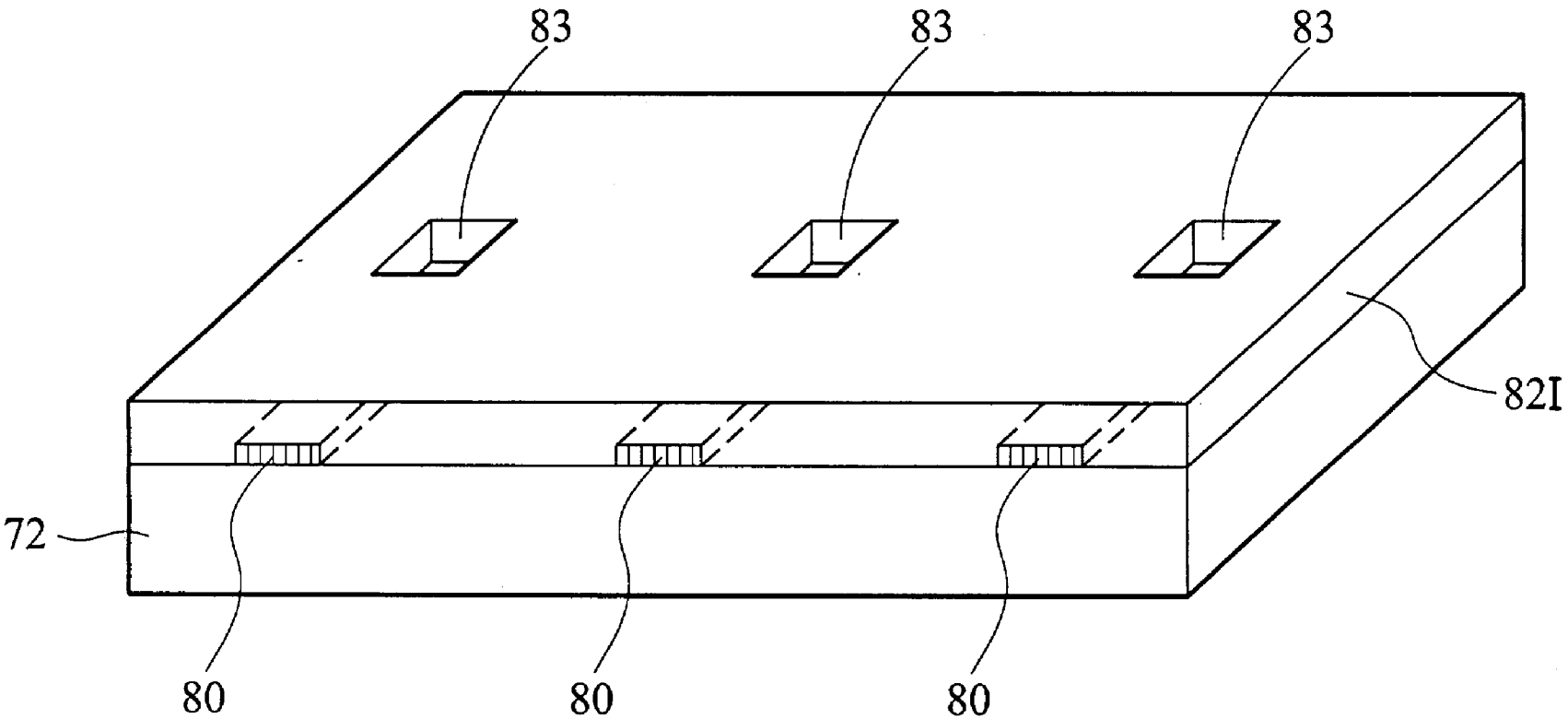
Figure 7C:
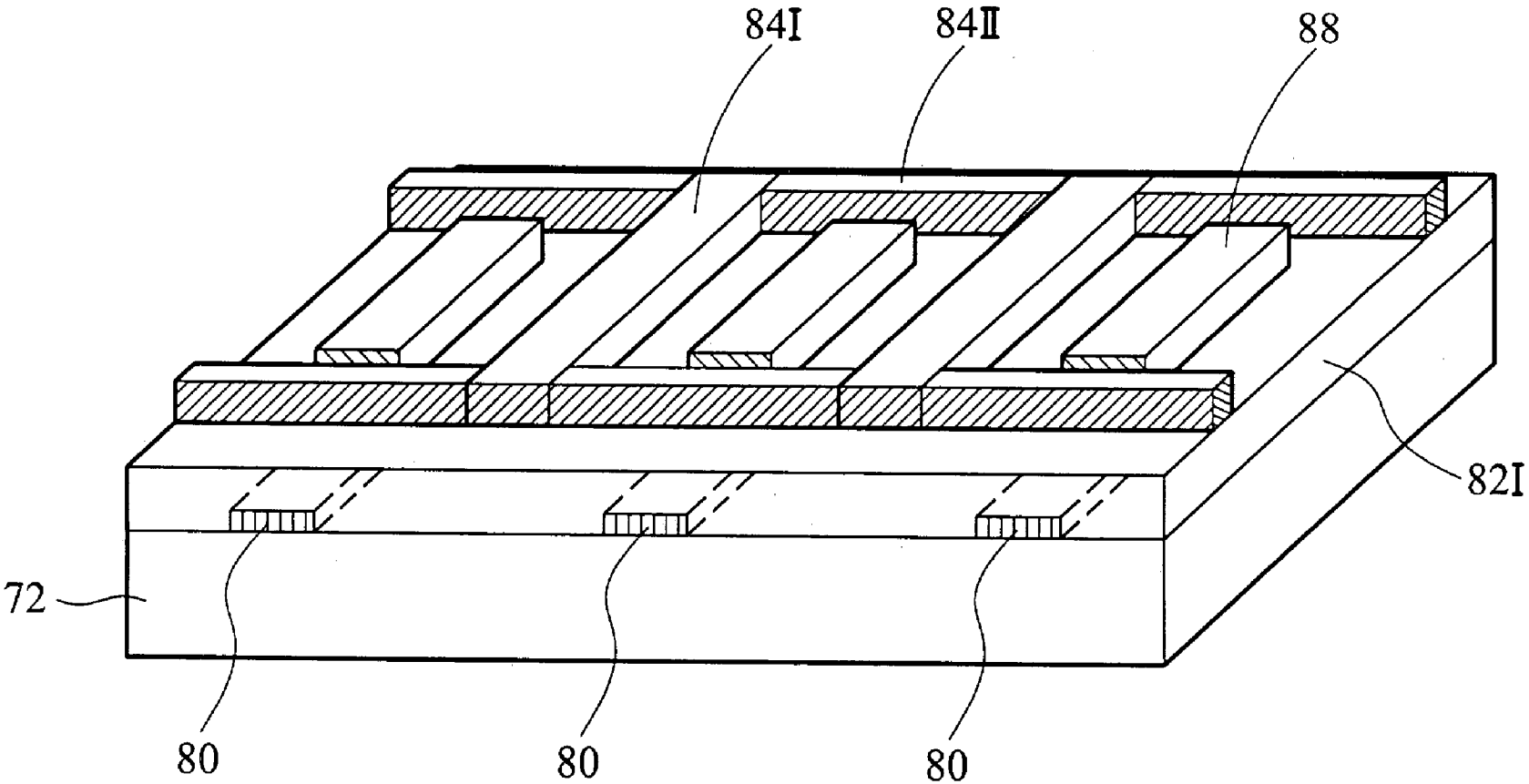

First, in FIG. 7A, using net printing or metal deposition with lithography, the conductive layer 80 of a lengthwise-stripe profile is patterned on the lower substrate 72. Then, in FIG. 7B, using net printing or deposition with lithography, the first dielectric layer 82I with the openings 83 arranged in a matrix is patterned on the entire surface of the lower substrate 72, in which each of the openings 83 exposes an area of the conductive layer 80 for electrically connecting to the gate layer 88. Next, First, in FIG. 7C, using net printing or metal deposition with lithography, a metal material is formed in the openings 83 to serve as the contact layers 85, respectively. Also, the metal material deposited on the first dielectric layer 82I is patterned as the cathode pattern 84 and the gate layers 88. The cathode pattern 84 comprises the first lengthwise-extending cathode layers 84I and the second transverse-extending cathode layers 84II which intersect each other to form the rectangular spacing of the matrix. The gate layers 88 arranged in a matrix are disposed in the rectangular spacings, respectively. Preferably, each of the first lengthwise-extending cathode layers 84I is disposed between two adjacent conductive layers 80, and each of the gate layers 88 is disposed within the rectangular spacing and electrically connected to the corresponding conductive layer 80 through the contact layer 85.

Figure 7D:
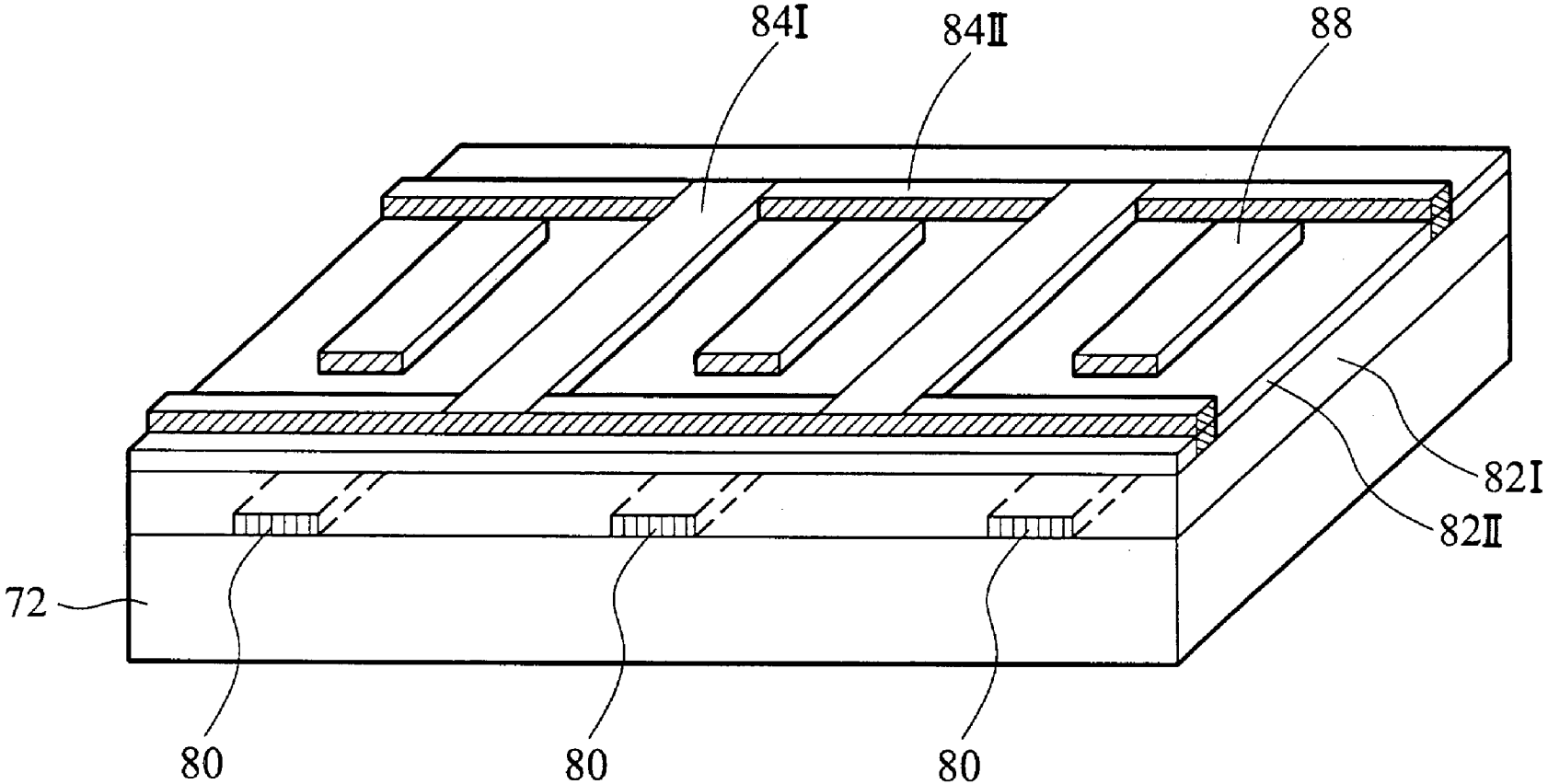
Figure 7E:
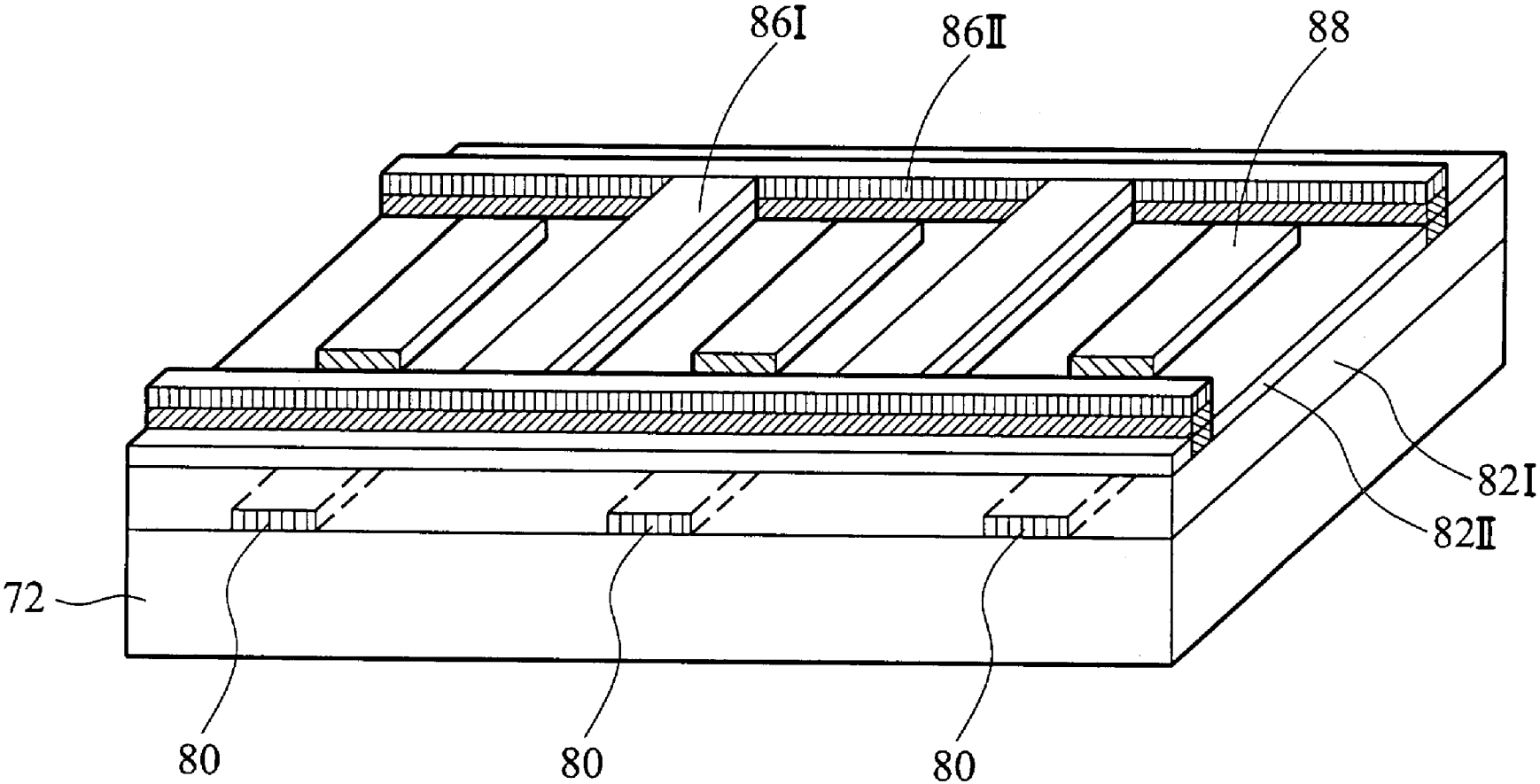

Next, in FIG. 7D, using net printing or deposition with lithography, the second dielectric layer 82I is deposited on the first dielectric layer 82I to fill the space between the cathode pattern 84 and the gate layer 88, in which the tops of the cathode pattern 84 and the gate layer 88 protrude from the second dielectric layer 82II. Finally, in FIG. 7E, using net printing or deposition with lithography, the emitting pattern 86 is patterned on the electron-emitting area of the cathode pattern 84. The emitting pattern 86 comprises the first lengthwise-extending emitting layers 86I and the second transverse-extending emitting layers 86II which intersect each other to from the rectangular spacing of the matrix.

According to the above-described fabrication method, the gate layer 88 and the cathode layers 84I and 84II are completed at the same step on the same plane to provide a plane emitting source. Also, the emitting layers 86I and 86II can be formed at the last procedure without suffering damage from the subsequent processes and a surface treatment can be further performed on the emitting pattern 86 to improve electron emitting characteristics thereof, resulting in stable emitting properties.

Third Embodiment

Figure 8:
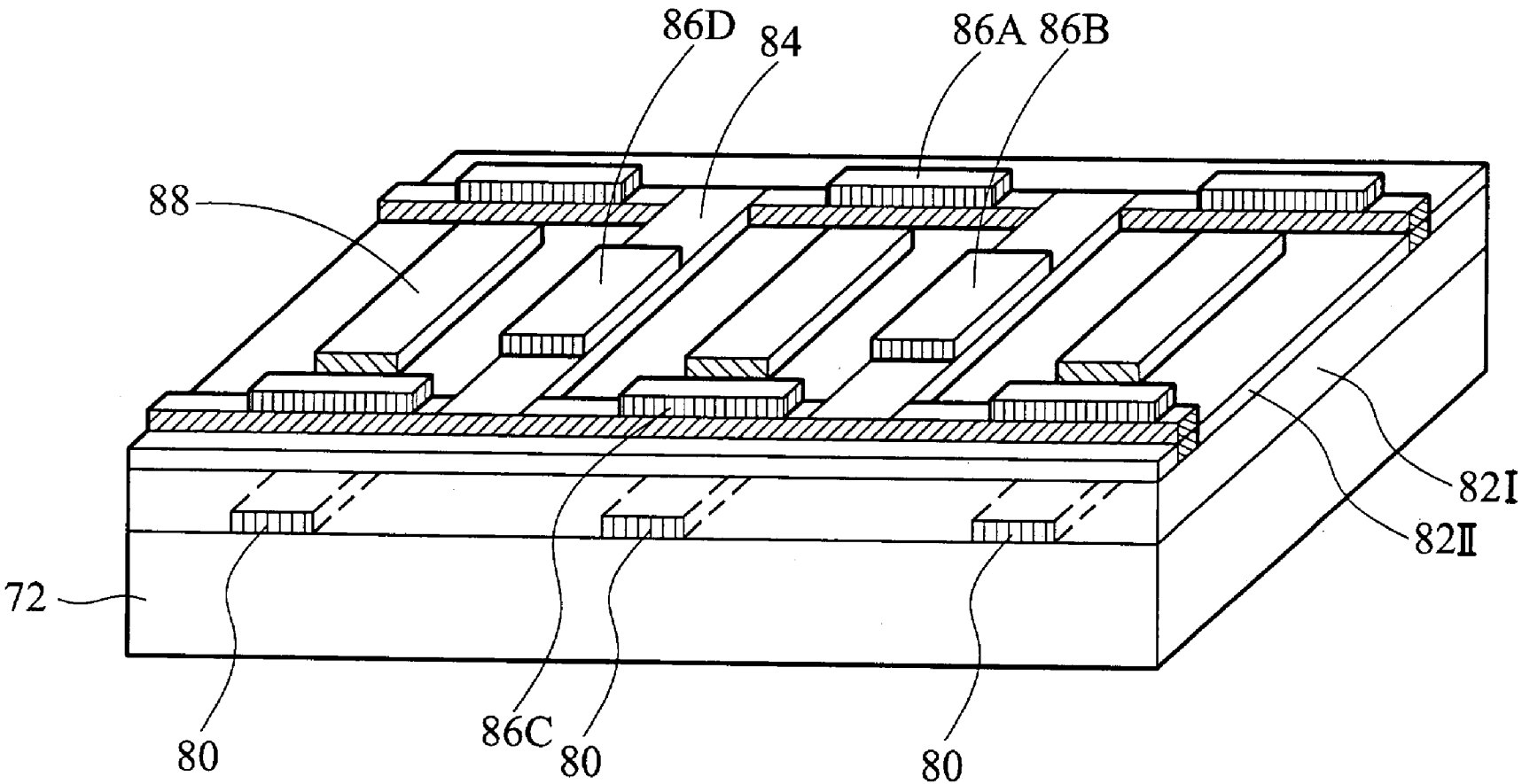
FIG. 8 is a solid diagram showing a triode structure of a FED device according to the third embodiment of the present invention.

FIG. 8 is a solid diagram showing a triode structure of a FED device according to the third embodiment of the present invention.

In accordance with the electrode structure on the lower substrate 72 described in the second embodiment, the third embodiment further modifies the emitting pattern 86 as a plurality of emitting elements 86A, 86B, 86C and 86D arranged in a matrix without connecting to each other. Preferably, the emitting element 86B or 86D is formed on the electron-emitting area of the first cathode layer 84I, and the emitting element 86A or 86C is formed on the electron-emitting area of the second cathode layer 84II. Thus, within one pixel area, the four lateral regions (ahead, right, behind and left regions) of the gate layer 88 are surrounded by the four emitting elements 86A, 86B, 86C, and 86D, respectively. The design choices consisting of area, profile and interval of the emitting elements 86A, 86B, 86C and 86D are not limited in the present invention.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A triode structure of a field emission display, comprising:

a lower substrate made of a transparent and insulating material;

a plurality of transverse-extending conductive layers formed overlying the inner surface of the lower substrate;

a dielectric layer formed overlying the conductive layers and the lower substrate, in which the dielectric layer comprises a plurality of openings arranged in a matrix to expose portions of the conductive layers;

a plurality of contact layers formed in the openings to electrically connect the conductive layers, respectively;

a plurality of cathode layers arranged in a matrix and formed overlying the dielectric layer, in which each of the cathode layers is connected to each of the contact layers;

a plurality of emitting layers arranged in a matrix, in which each of the emitting layers is formed overlying an electron-emitting area of each cathode layer; and a plurality of lengthwise-extending gate layers formed on the dielectric layer, in which each of the gate layers is disposed between two adjacent columns of the cathode layers, wherein the gate layers and the cathode layers are on the same level relative to a top surface of the dielectric layer.

2. The triode structure of a field emission display as claimed in claim 1, wherein the emitting layer is a carbon nanotube (CNT) film, a nano-particle layer made of carbon sphere, nano cluster or CNF, a diamond film or a porous silicon film to serve as a nano-scale plane emitting source.

3. The triode structure of a field emission display as claimed in claim 1, further comprising:

an upper substrate made of a transparent and insulating material;

a plurality of transverse-extending anode layers formed overlying the inner surface of the upper substrate; and a plurality of fluorescent layers arranged in a matrix.

4. The triode structure of a field emission display as claimed in claim 1, wherein the gate layers and the cathode layers comprise a single patterned metal layer in a single horizontal plane formed directly over and in physical contact with the dielectric layer.

5. The triode structure of a field emission display as claimed in claim 1, wherein the gate layers and the cathode layers are formed at equal distance from the lower substrate.

6. A triode structure of a field emission display, comprising:

a lower substrate made of a transparent and insulating material;

a plurality of lengthwise-extending conductive layers formed overlying the inner surface of the lower substrate;

a first dielectric layer formed overlying the conductive layers and the lower substrate, in which the first dielectric layer comprises a plurality of openings to expose portions of the conductive layers;

a plurality of contact layers formed in the openings to electrically connect the conductive layers, respectively;

a cathode pattern formed overlying the first dielectric layer, in which the cathode pattern comprises a plurality of first lengthwise-extending cathode layers and a plurality of second transverse-extending cathode layers that intersect to define a plurality of rectangular spacings arranged in a matrix;

a plurality of lengthwise-extending gate layers formed overlying the first dielectric layer, in which each of the gate layers is disposed in each of the rectangular spacings and electrically connected to each of the contact layers, wherein the gate layers and the cathode pattern are on the same level relative to a top surface of the dielectric layer;

a second dielectric layer formed overlying the first dielectric layer and partially filling the space between the cathode pattern and the gate layer, in which the top of the cathode pattern and the top of the gate layer protrude from the second dielectric layer; and an emitting pattern formed overlying the electron-emitting area of the cathode pattern.

7. The triode structure of a field emission display as claimed in claim 6, wherein the emitting pattern comprises:

a plurality of first lengthwise-extending emitting layers formed overlying the first cathode layers, respectively; and a plurality of second transverse-extending emitting layers formed overlying the second cathode layers, respectively;

wherein, the first emitting layers and the second emitting layers define a plurality of rectangular spacings arranged in a matrix; and wherein, each of the gate layers is disposed within each of the rectangular spacings to be four-laterally surrounded by the two adjacent first emitting layers and the two adjacent second emitting layers.

8. The triode structure of a field emission display as claimed in claim 6, wherein the emitting pattern comprises:

a plurality of first emitting elements arranged in a matrix and disposed on the first cathode layers;

a plurality of second emitting elements arranged in a matrix and disposed on the second cathode layers;

wherein, each of the gate layers is surrounded by at least two of the first emitting elements and two of the second emitting elements.

9. The triode structure of a field emission display as claimed in claim 6, wherein the emitting layer is a carbon nanotube (CNT) film, a nano-particle layer made of carbon sphere, nano cluster or CNF, a diamond film or a porous silicon film to serve as a nano-scale plane emitting source.

10. The triode structure of a field emission display as claimed in claim 6, further comprising:

an upper substrate made of a transparent and insulating material;

a plurality of transverse-extending anode layers formed overlying the inner surface of the upper substrate; and a plurality of fluorescent layers arranged in a matrix.

11. The triode structure of a field emission display as claimed in claim 6, wherein the gate layers and the cathode pattern comprise a single patterned metal layer in a single horizontal plane formed directly over and in physical contact with the first dielectric layer.

12. The triode structure of a field emission display as claimed in claim 6, wherein the gate layers and the cathode pattern are formed at equal distance from the lower substrate.

* * * * *